US007770409B2

(12) United States Patent
Anderson

(10) Patent No.: US 7,770,409 B2
(45) Date of Patent: Aug. 10, 2010

(54) REFRIGERATOR FREEZER DOOR ICE MAKER

(75) Inventor: Ronald K. Anderson, Sidney, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/021,009

(22) Filed: Jan. 28, 2008

(65) Prior Publication Data

US 2008/0115521 A1 May 22, 2008

Related U.S. Application Data

(63) Continuation of application No. 11/074,356, filed on Mar. 7, 2005, now Pat. No. 7,337,617.

(51) Int. Cl.
*F25C 5/18* (2006.01)

(52) U.S. Cl. ..... 62/344

(58) Field of Classification Search ..... 62/344, 62/353

See application file for complete search history.

(56) References Cited

U.S. PATENT DOCUMENTS 3,602,007 A 8/1971 Driecl
3,747,363 A 7/1973 Grimm
4,100,761 A 7/1978 Linstromberg et al.
4,227,383 A 10/1980 Horvay
4,285,212 A 8/1981 Prada
4,306,757 A 12/1981 Horvay et al.
5,375,432 A 12/1994 Cur
5,910,164 A * 6/1999 Snelling et al. ..... 62/344
6,050,097 A 4/2000 Nelson et al.
6,148,624 A * 11/2000 Bishop et al. ..... 62/137
6,425,259 B2 * 7/2002 Nelson et al. ..... 62/344
6,735,959 B1 5/2004 Najewicz
6,904,765 B2 6/2005 Lee et al.
6,945,068 B2 9/2005 Kim et al.
7,017,364 B2 3/2006 Lee et al.
7,040,111 B2 5/2006 Lee et al.
7,228,701 B2 6/2007 Kim
7,240,511 B2 7/2007 Lee et al.

FOREIGN PATENT DOCUMENTS

WO 03/102481 A1 12/2003

* cited by examiner

*Primary Examiner*—William E Tapolcai
(74) *Attorney, Agent, or Firm*—Kirk W. Goodwin; McKee, Voorhees & Sease, PLC

(57) ABSTRACT

An ice maker and ice bin are provided on the inside of a freezer door of a refrigerator. The ice maker is compact, and the bin is removably mounted to the door. Ice is made by the ice maker on the door, and discharged into the ice bin, which then feeds the ice to an ice dispenser when the dispenser is actuated by a person.

11 Claims, 3 Drawing Sheets

REFRIGERATOR FREEZER DOOR ICE MAKER

CROSS-REFERENCE TO RELATED APPLICATIONS

This is a continuation application of U.S. application Ser. No. 11/074,356 filed Mar. 7, 2005, which application is hereby incorporated by reference in its entirety.

BACKGROUND OF THE INVENTION

Refrigerators commonly have a freezer compartment with an automatic ice maker therein. A bin is typically associated with the ice maker to receive and hold the ice until a person activates the ice dispenser. Ice making and dispensing through the freezer door are important value-added features on refrigerators.

The ice maker and ice bin normally consume premium, eye-level space in the freezer. To conserve the premium freezer space, some refrigerators have moved the ice bin to the inside of the freezer door, though the ice maker remains mounted in the freezer compartment.

Therefore, a primary objective of the present invention is the provision of an ice maker and ice bin which are mounted on the inside of the freezer door of a refrigerator so as to increase useable space in the freezer compartment.

Another objective of the present invention is the provision of a method of making ice in the freezer door, as opposed to the freezer compartment, so as to maximize freezer space.

A further objective of the present invention is the provision of a freezer door ice making system which is efficient and durable in use, and economical to manufacture.

These and other objectives will become apparent from the following description of the invention.

SUMMARY OF THE INVENTION

The refrigerator includes a freezer compartment with a door moveable between open and closed positions relative to the freezer compartment. A compact ice maker is mounted on the inside of the freezer door, along with an ice bin for receiving ice from the ice maker. The bin is in communication with an ice dispenser mounted in the door so that ice can be supplied on demand without opening the door. The bin is removably mounted to the door and includes an auger to preclude ice bridging and supply ice to the dispenser.

In the method of the invention, water is supplied to the ice maker on the freezer door so as to make ice, and ice is discharged from the ice maker into the bin on the freezer door, for subsequent dispensing through the dispenser, upon actuation by a person.

DETAILED DESCRIPTION OF THE PREFERRED EMBODIMENT

Figure 1:
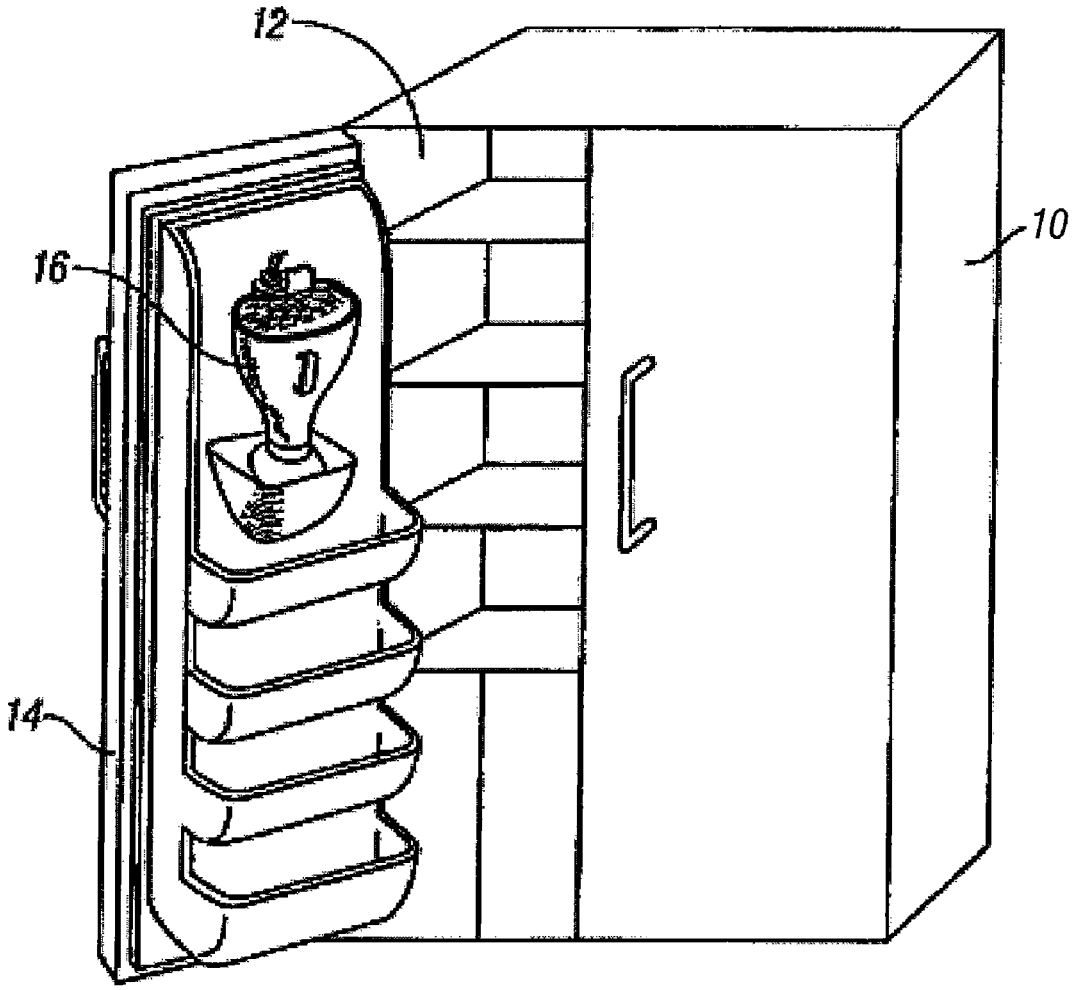
FIG. 1 is a view of a refrigerator having a freezer compartment and showing the freezer door in an open position with the ice system of the present invention.
Figure 2:
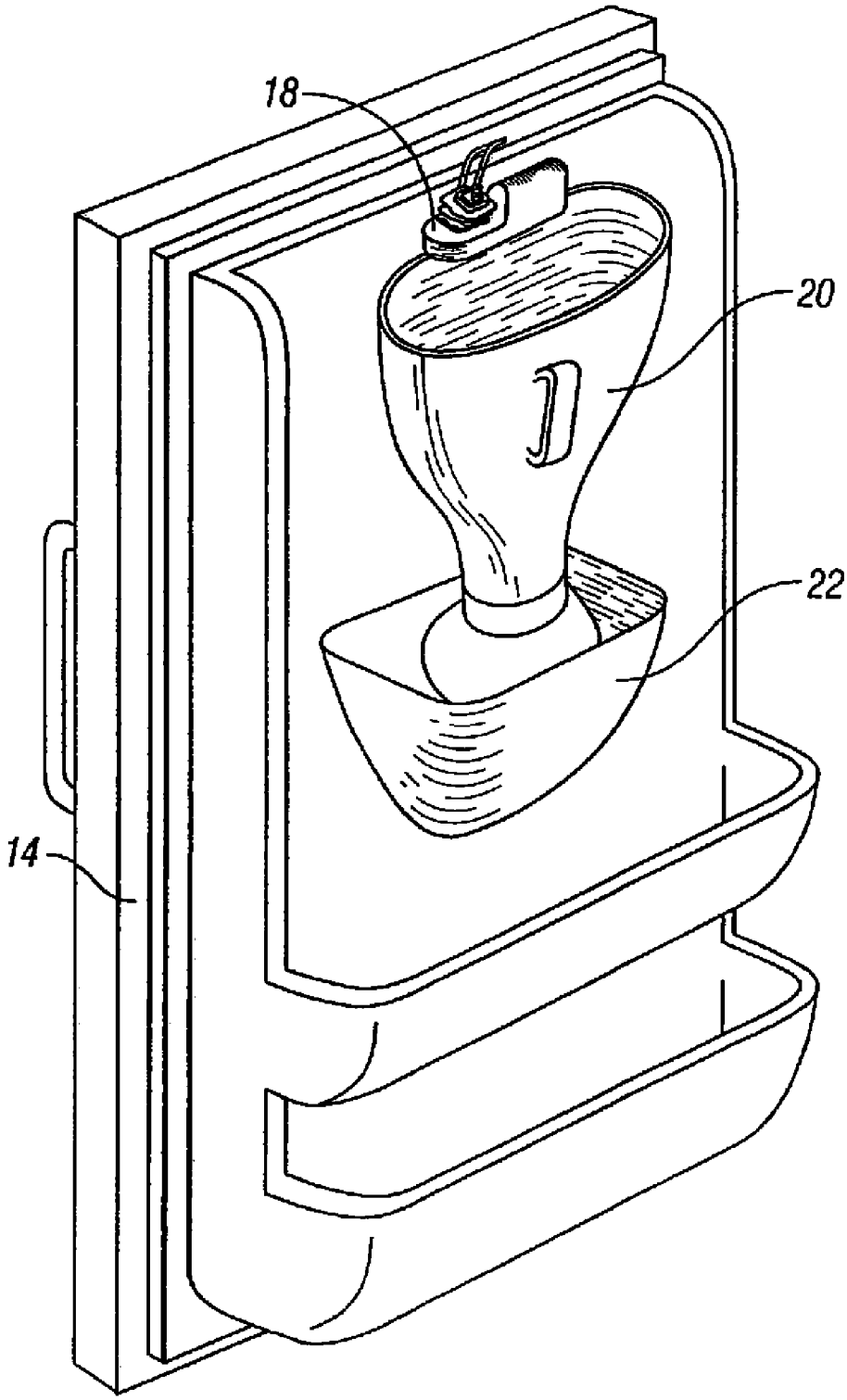
FIG. 2 is an enlarged perspective view of the inside of the freezer door with the ice maker and ice bin of the present invention.

A refrigerator is generally designated in the drawings by the reference numeral 10. The refrigerator 10 includes a freezer compartment 12, with a freezer door 14 moveable between open and closed positions relative to the freezer compartment 12. In FIG. 1, the freezer door 14 is shown in an open position.

Figure 3:
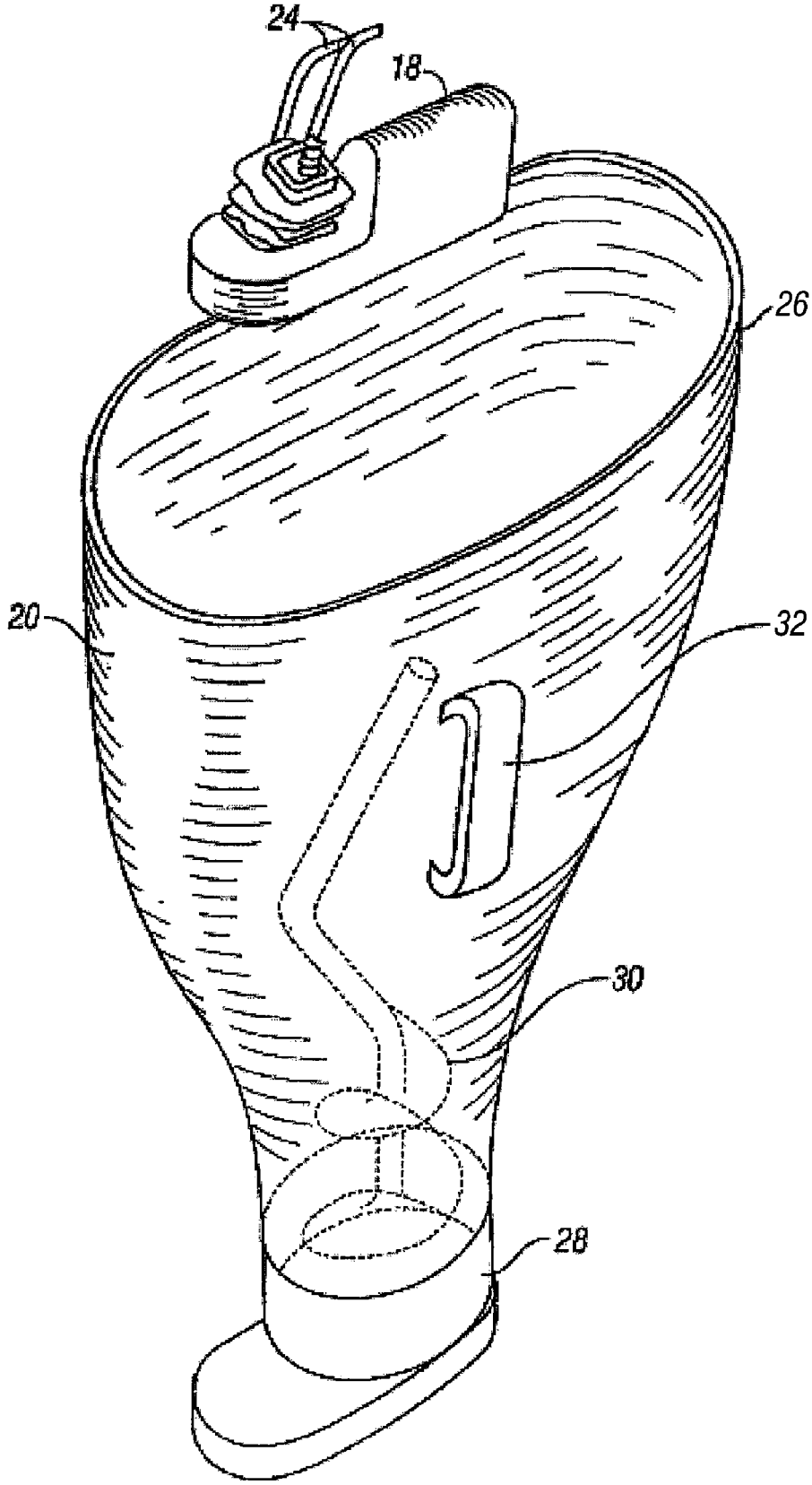
FIG. 3 is an enlarged perspective view of the ice maker and ice bin of the present invention.

The present invention is directed towards an ice making and dispensing system 16 which is mounted on the inside of the freezer door 14. The ice system 16 includes an ice maker 18, an ice bin 20 and an ice dispenser 22. As best seen in FIG. 3, one or more water lines 24 supply water to the ice maker.

Preferably, the ice maker 18 is relatively compact so as to minimize the area it occupies on the door 14, and accordingly maximize the area available on the inside of the door 14 for the ice bin 20. The ice bin 20 has an open upper end 26 which is positioned immediately beneath the outlet of the ice maker 18. The base or lower end 28 of the ice maker 18 is adjacent to and in communication with the ice dispenser 22. An auger 30 is provided in the ice maker 18 so as to break up any ice bridges which form in the bin 20. The motor (not shown) for the auger 30 is provided in the base or lower end 28 of the bin 20. The bin includes a handle 32, and is detachably mounted to the inside of the freezer door 14.

The ice dispenser 22 is conventional in construction, and supplies ice in the bin 20 to the outside of the door 14 upon demand by a person.

In the method of the present invention, water is supplied through the lines 24 to the ice maker 18 on the door 14. After ice is made, the ice maker 18 discharges the ice into the ice bin 20, which stores the ice until a person actuates the ice dispenser 22 so as to dispense ice into a glass, cup or other container on the outside of the freezer door 14.

It is understood that the dispenser 22 may be eliminated to make a lower priced refrigerator.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A refrigerator comprising:

a freezer compartment;

a door movable between open and closed positions relative to the freezer compartment;

an ice maker on the door;

an ice bin on the door beneath the ice maker, with an open top to receive ice from the ice maker and a lower ice discharge opening, wherein the bin has a rear wall that is proximate to the door, a front wall that is spaced apart from the rear wall, and a pair of side walls, the side walls sloping laterally inwardly from an enlarged area upper end to a reduced area lower end so as to funnel ice to the ice discharge opening such that the ice bin covers a smaller lateral portion of the door at the lower end than at the upper end, whereby ice moves by gravity to the ice discharge opening;

an ice dispenser in the door to supply ice outside the door without opening the door; and a rotatable arm extending substantially vertically in the ice bin to prevent ice bridging.

2. The refrigerator of claim 1 wherein the ice bin is detachable from the door.

3. The refrigerator of claim 1 wherein the bin includes a handle.

4. The refrigerator of claim 1 further comprising a water supply line connected to the ice maker.

5. An improved refrigerator having a freezer compartment and a fresh food compartment, a freezer door and a fresh food door, the improvement comprising:

an ice maker mounted on an inside portion of the freezer door;

a funnel-shaped ice bin removably mounted on the inside portion of the freezer door, and having an open upper end and a lower end with an ice discharge opening, and wherein the bin has a sidewall that slopes laterally inwardly from an enlarged area upper end to a reduced area lower end so as to funnel ice to the ice discharge opening and such that the ice bin covers a smaller portion of the door at the lower end than at the upper end; and an ice dispenser in the freezer door to dispense ice from the bin without opening the door.

6. The improved refrigerator of claim 5 further comprising a vertical auger rotatably mounted in the bin.

7. An ice bin for removable mounting to an inner surface of a door, the door being of the type having an ice maker mounted on the door and an ice dispenser for dispensing ice through the door, the bin having a rear side that faces the inner surface of the door when the ice bin is mounted on the door and a front side that is opposite from the rear side, the bin comprising:

a continuous wall forming an enclosure that has an open upper end for receiving ice from the ice maker and a lower end having a discharge opening in communication with the ice dispenser, the continuous wall having a rear portion that forms the rear side and a front portion that forms the front side, and a pair of laterally spaced apart side wall portions that span between the front and rear portions, the side wall portions sloping laterally inwardly from an enlarged area portion at the upper end to a reduced area portion at the lower end so as to funnel ice to the discharge opening and such that the lower end covers a smaller lateral area of the door than if the side wall portions did not slope laterally inward.

8. The ice bin of claim 7, further comprising a handle on the front side of the bin for detaching the bin from the door and for carrying the bin.

9. The ice bin of claim 8, wherein the handle is a generally vertically oriented member attached to the continuous wall.

10. The ice bin of claim 7, wherein the continuous wall slopes rearwardly from a front side of the enlarged area portion to the reduced area portion.

11. The ice bin of claim 10, wherein the continuous wall slopes frontwardly from a rear side of the enlarged area portion to the reduced area portion.

* * * * *